US008424682B2

(12) United States Patent
Cassina

(10) Patent No.: US 8,424,682 B2
(45) Date of Patent: Apr. 23, 2013

(54) TRANSPORT AND STORAGE CONTAINER

(75) Inventor: Virginio Cassina, Gorle (IT)

(73) Assignee: Greif International Holding B.V., Vreeland (NL)

( * ) Notice: Subject to any disclaimer, the term of this patent is extended or adjusted under 35 U.S.C. 154(b) by 0 days.

(21) Appl. No.: 12/533,426

(22) Filed: Jul. 31, 2009

(65) Prior Publication Data

US 2010/0025275 A1 Feb. 4, 2010

(30) Foreign Application Priority Data

Aug. 1, 2008 (EP) ..... 08398009

(51) Int. Cl.
*B65D 19/00* (2006.01)

(52) U.S. Cl.
USPC ..... 206/386; 220/495.05

(58) Field of Classification Search ..... 206/386, 206/600; 220/1.6, 9.4, 495.05, 495.06, 495.01, 220/495.03, 23.91
See application file for complete search history.

(56) References Cited

U.S. PATENT DOCUMENTS

| | | | | |
|---|---|---|---|---|
| 5,622,277 | A * | 4/1997 | Van Giezen et al. | 220/6 |
| 6,223,903 | B1 * | 5/2001 | Mansouri | 206/600 |
| 6,454,113 | B1 | 9/2002 | Schutz | |
| 6,550,628 | B1 * | 4/2003 | Sedlmayr | 220/9.1 |
| 6,575,629 | B1 * | 6/2003 | Perkins | 383/105 |
| 7,337,908 | B2 * | 3/2008 | Dedmon | 206/600 |
| 2003/0230580 | A1 * | 12/2003 | Schutz | 220/495.03 |
| 2005/0145521 | A1 | 7/2005 | Perkins | |
| 2006/0027582 | A1 * | 2/2006 | Beach | 220/495.05 |
| 2006/0180589 | A1 * | 8/2006 | De Muinck | 220/495.06 |
| 2009/0250460 | A1 * | 10/2009 | Chang | 220/9.4 |

FOREIGN PATENT DOCUMENTS

| | | | |
|---|---|---|---|
| EP | 0472360 | A2 | 2/1992 |
| FR | 2675784 | A1 | 10/1992 |
| WO | WO 2004/022440 | A1 | 3/2004 |
| WO | 2007/029011 | A1 | 3/2007 |

OTHER PUBLICATIONS

European Search Report issued from Application No. EP 08398009, dated Jan. 7, 2009, 4 pages.

* cited by examiner

*Primary Examiner* — J. Gregory Pickett
*Assistant Examiner* — Robert Poon
(74) *Attorney, Agent, or Firm* — Rothwell, Figg, Ernst & Manbeck PC

(57) ABSTRACT

A container for transport and storage of liquids comprises a pallet and a metal cage of standard dimensions. The container comprises also an inner bag made of plastic material, an outer envelope disposed between the inner bag and the metal cage, and fastened to the metal cage. The inner bag is not fastened to the outer envelope and is configured to be filled to unfold from an empty condition, in which the inner bag is in a flattened and folded configuration to a filled condition, in which the inner bag is in a parallelepipedal and unfolded configuration, having a volume corresponding substantially to the volume of the housing of the cage and being surrounded by the outer envelope and the metal cage.

3 Claims, 3 Drawing Sheets

TRANSPORT AND STORAGE CONTAINER

TECHNICAL FIELD

The present invention relates to a transport and storage container.

BACKGROUND OF THE INVENTION

Containers are known and widely used for transport and storage of materials, such as liquids, powders, pastes and granular materials.

Containers are produced to be returnable or non-returnable.

Non-returnable containers are used when the cost of returning the container is not convenient for any reason. They are designed such that they can be sufficiently economically produced so that they can be discarded after one use.

A non-returnable container is disclosed in EP 0 472 360. The container comprises a pallet and placed thereon an inner liner bag, an outer bag member and a frame surrounding the liner bag and the bag member. The frame is a collapsible frame so that it can be manufactured in separate parts and the entire container can be sent to a user in a non-assembled condition.

It is evident that it would desirable to reuse the container not only for economical reason but also for environment pollution reasons. Then, single-use containers, such as pallet containers for transport and storage of liquids, have to be substituted with multi-use containers.

A multiuse container is disclosed in US 2005/0145521. The container comprises a pallet and placed thereon a inner liner of polyethylene, an outer skin of a woven polypropylene fabric-like material and a rigid framework to which the outer skin is secured. Since this container does not meet the requirement of standard pallet containers, it is not interchangeable with other pallet containers. Therefore, the container can be reused only for the same single specific application and not for different applications. Alternatively, it can be returned but with high returning costs.

Another multiuse container is disclosed in WO 2004/022440. The container comprises a containing box-structure defining a housing and a bag that is arranged in the housing and can be filled so as to pass from a flattened empty condition to a filled condition in which the bag has a volume that corresponds substantially to the volume of the housing of the box structure. The containing box structure comprises a base and a side wall which extends vertically from the base. The box structure is typically made of cardboard, plastic or steel. In the cardboard version, the box structure is a disposable structure and cannot therefore be reused. Consequently, once it has reached the final user, this box structure must be disposed off, resulting in problems of accumulation of waste material and the consequent cost of disposal. This box structure is also intrinsically weak and not suitable for excessively long journeys. In the plastic or steel version, the box structure is more robust and can be reused more than once but, considering its high production costs, it must be returned to the proprietor with the consequent impact of the costs of returning and/or cleaning the box structure so that it can be reused. In fact, since the plastic box does not meet the requirement of standard pallet containers, it is not interchangeable with other containers and so it can be reused only for a single specific application.

Another multiuse container is disclosed in WO 2007/029011. The container comprises a rigid framework, made of sheet metal or in the form of a mesh. Into the rigid framework is placed a vessel including an inner layer and an outer layer and having an inlet aperture and an outlet aperture. Outer and inner layers are joined at first seams adjacent and surrounding inlet and outlet apertures and by seams at the edge of the vertical sides. The inner liquid vessel is folded when the container does not contain any liquid and at least one portion of the inner vessel is substantially vertical and follows the vertical faces of the outer vessel and the vertical wall of the container and unfolds automatically as liquid in introduced into the container. Since the inlet of the inner vessel is joined to the outer vessel in a predefined position, the container can only be used with specific filling heads that, when the container is placed in position to be filled, are in line with the inlet. Therefore, even if the vessel is suitable for use with conventional crate and pallet containers, the container can not be used with any filling head and so it does not meet the required requirements of versatility. Since the neck of the inner vessel is connected to the outer vessel through the inlet device, it comes out that, after the first use, it is necessary disposal of both the inner vessel and the outer vessel which are connected to each others. Another multi-use container is disclosed in U.S. Pat. No. 6,454,113. The container comprises a pallet, a metal cage placed on the pallet, an inner container placed on the pallet into the metal cage. The inner container comprises an outer envelope of a woven material and an inner envelope of plastic foil positioned in the outer envelope. The longitudinal edge strips of the inner envelope are sewn or glued to the mantle, bottom and cover pieces of the outer envelope to form the inner container. The inner envelope is therefore arranged in a unfolded configuration, sewn or glued to the outer envelope and ready to be filled by liquid. The method of manufacturing of this container is extremely complicated since inner envelope and outer envelope must be sewn or glued together. Moreover, it should be noted that, after use of the container, inner envelope and outer envelope are wasted and the outer envelope can not be reused. As in WO 2007/029011, since the inner envelope is connected to the outer envelope, after the first use, it is necessary disposal of both the inner envelope and the outer envelope.

SUMMARY OF THE INVENTION

The object of the present invention is to propose a container which is multiuse even for different applications and at the same time avoid the drawbacks found with reference to the known art.

This object is achieved by a container for transport and storage of liquids comprising a pallet having a supporting platform with a bearing surface, the supporting platform having longitudinal dimension of 1200 mm and width dimension of 1000 mm or 800 mm, a metal cage mounted on the pallet and defining a housing, the metal cage comprising crossing vertical and horizontal metal tubes welded together at crossover points to form a lattice structure with a plurality of grids defining a respective plurality of openings, the metal cage developing vertically from the bearing surface of the pallet and having longitudinal and width dimension corresponding to longitudinal and width dimension of the pallet, an inner bag made of plastic material, the inner bag having at least one opening for filling and/or emptying, an outer envelope positioned in the housing of the metal cage and fastened to the metal cage, the outer envelope being flexible so as to be folded and/or rolled in a reversible manner, the outer envelope having a bottom supported by the bearing surface, side walls developing vertically from the bottom, an upper opening for introducing the inner bag in the outer envelope and a top cover for closing the upper opening, wherein the inner bag is positioned in the outer envelope, the inner bag is not fastened to the outer envelope, the inner bag is configured to be filled to pass from an empty condition to a filled condition, in the empty condition, the inner bag being in a flattened and folded configuration, in the filled condition, the inner bag being in a parallelepipedal and unfolded configuration, having a volume corresponding substantially to the volume of the housing and being surrounded by the outer envelope and the metal cage, when filling to pass from the empty condition to the filled condition, the inner bag unfolds from the flattened and folded configuration to the parallelepipedal and unfolded configuration.

BRIEF DESCRIPTION OF THE DRAWINGS

Further features and advantages of the container according to the present invention will emerge from the following description of a preferred embodiment which is given by way of a non-limiting example with reference to the accompanying drawings, in which.

DETAILED DESCRIPTION OF THE PREFERRED EMBODIMENTS

Figure 1:
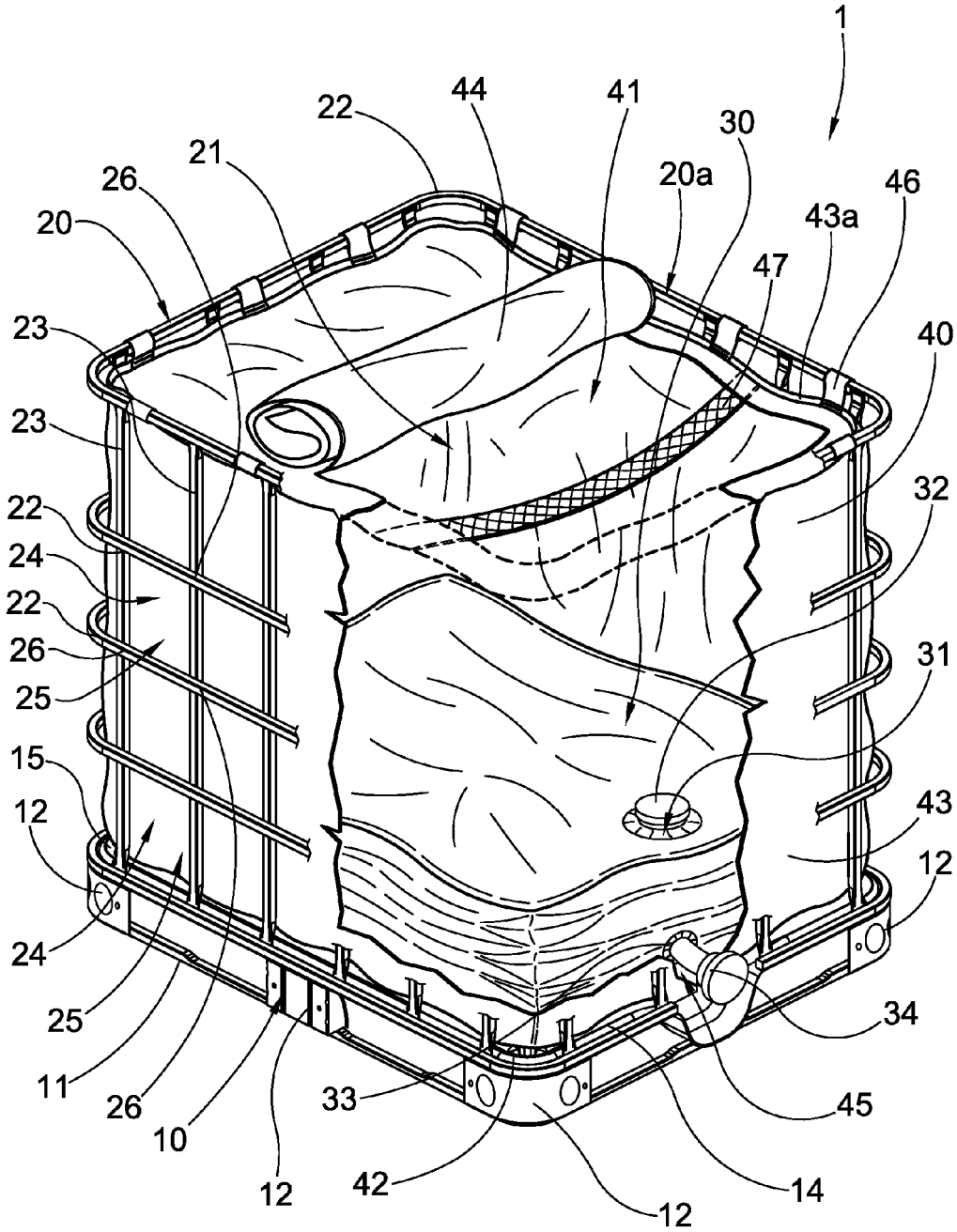
FIG. 1 is a perspective cutaway view of a container according to the present invention in which the bag is in the empty condition.
Figure 2:
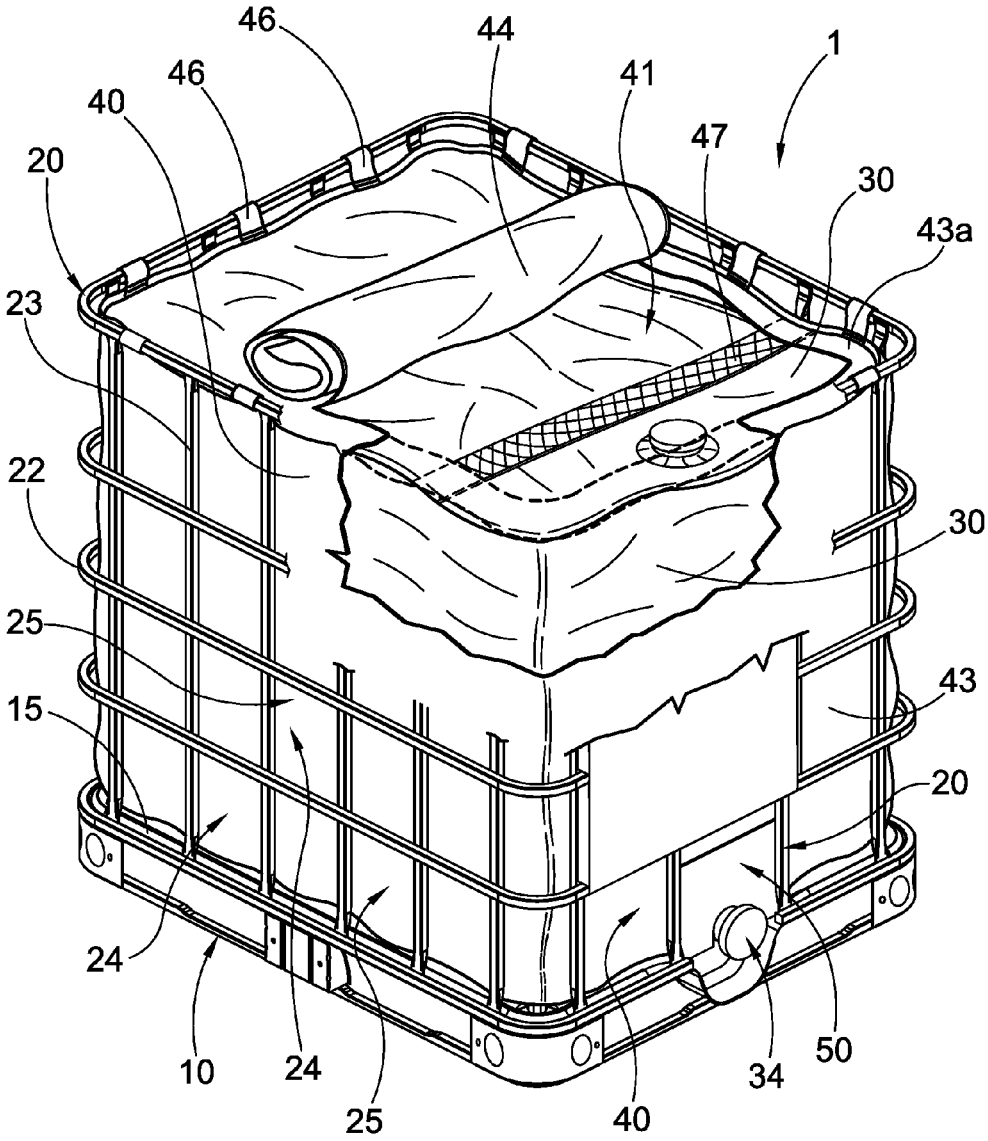
FIG. 2 is a perspective cutaway view of the container in FIG. 1 in which the bag is in the filled condition.
Figure 3:
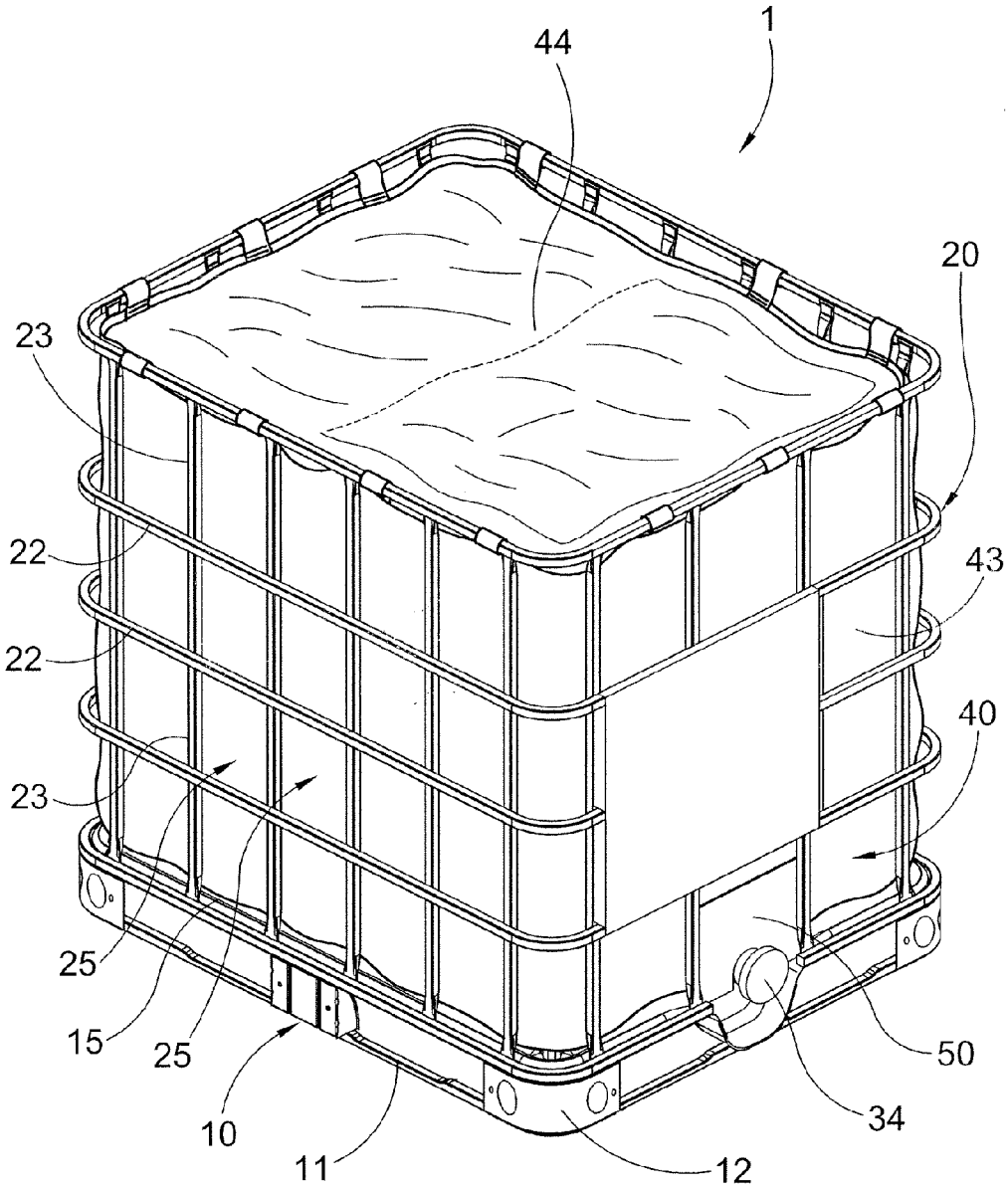
FIG. 3 is a perspective view of the container in FIG. 1 with the bag in the filled condition and closed at the top.

FIG. 1 shows a container 1 for the transportation and/or storage of materials, such as liquids, powders, pastes, granular material and suchlike.

The container 1 comprises a pallet 10 having a base frame 11, a plurality of bearing elements 12, specifically central feet and corner feet, mounted on the base frame 11, a supporting element (not shown in the figures) having two opposing end portions, each connected to a respective central foot, and a supporting platform 14 mounted on the supporting element and defining the bearing surface 15.

The pallet 10 can be made of metal, wood or plastic.

The container 1 comprises also a metal cage 20 mounted on the pallet 10 and fastened thereto by fastening means not shown in the accompanying figures.

The metal cage 20 comprises a plurality of horizontal 22 and vertical 23 metal tubes welded together at crossover points 26 to form a lattice structure with a plurality of grids 24 defining a respective plurality of openings 25.

The metal cage 20 develops vertically from the bearing surface 15 of the pallet 10 so as to define a housing 21 and has longitudinal and width dimension corresponding to the longitudinal and width dimension of the pallet 10.

The metal 20 is therefore mounted on the supporting platform 14 of the pallet 10. The bearing feet 12, the supporting element and the supporting platform 14 of the pallet 10 can be made of a metal material or alternatively of a plastics material.

The pallet 10 and the metal cage 20 define a pallet container having dimensions configured to allow stackability of two or more pallet containers.

The upper end of the metal cage 20 and the bottom end of the pallet 10 have longitudinal and width dimensions configured to allow stackability of pallet containers.

To this purpose, the pallet 10 has longitudinal and width dimension meeting the European standard "Euronorm".

In particular, the supporting platform 14 of the pallet 10 has longitudinal dimension of 1200 mm and width dimension of 1000 mm or 800 mm. For example, with dimensions of 1200 mm and 800 mm, the pallet 10 conforms to UIC 435-2/EUR-1. Accordingly, the cage 20 has longitudinal dimension of 1200 mm and width dimension of 1000 mm or 800 mm. The most diffused and preferred embodiment is a pallet with longitudinal dimension of 1200 mm and width dimension of 1000 mm.

In order to allow a pallet container with pallet 10 and metal cage 20 to be stacked on the metal cage of another pallet container, the bottom end of the pallet 10, in the example the base frame 11, has lower longitudinal and width dimensions with respect to the longitudinal and width dimensions of the upper end of the metal cage 20. In particular, given a horizontal tube 22 forming the metal cage 20 with thickness of 18 mm, the bottom end of the pallet 10 has longitudinal and width dimension of 1200−18*2=1164 mm and width dimension of 1000−18*2=964 mm. The same calculation can be done for a tube of 16 mm. Typically, longitudinal and width dimensions of 1150 mm and 950 mm are chosen to allow stackability with any pallet container.

The container 1 comprises also an inner bag 30 made of plastic material.

According to one embodiment, the inner bag 30 is made of a plastics material suitable for the transportation and storage of liquids and/or food pastes, such as juices, milk, confectionary pastes and pastes for drinks, as well as for the transportation of chemical products such as chemical bases for pharmaceutical or chemical industry. For example, the inner bag 30 may be made of low-density polyethylene.

The inner bag 30 may be single- or multi-layered with thicknesses of less than 100 μm.

The inner bag 30 has at least one opening for filling and/or emptying the bag. According to the embodiment shown in the accompanying figures, the inner bag 30 has a filling opening 31 equipped with a cap 32 and an emptying opening 33 equipped with a draining device 34. According to a different embodiment, the opening 33 may be used for filling and for emptying operations.

The container 1 comprises also an outer envelope 40 positioned in the housing 21 defined by the metal cage 20, between the inner bag 30 and the metal cage 20, and fastened to the metal cage 20.

The outer envelope 40 is made of a material flexible so as to be folded and/or rolled in a reversible manner. For example, the outer envelope 40 can be made of a polypropylene fabric, non-woven fabric, jute, possibly covered internally and/or externally with polyethylene or other plastics materials.

The outer envelope 40 comprises a bottom 42 supported by the bearing surface 15, side walls 43 developing vertically from the bottom 42, an upper opening 41 for introducing the inner bag 30 in the outer envelope 40 and a top cover 44 for closing the upper opening 41.

According to one embodiment, the top cover 44 is configured to pass in a reversible manner from an opened position to a closed position for allowing access inside the outer envelope 40 through the upper opening 41 and for closing the upper opening 41, respectively.

Moreover, the inner bag 30 is not fastened to the outer envelope 40, for example by gluing, sewing or any other fastening means. In other words, the inner bag 30 is loose with respect to the outer envelope, so that the inner bag 30 is free to move with respect to the outer envelope 40.

The inner bag 30 is configured to pass from an empty condition to a filled condition.

In particular, in the empty condition, the inner bag 30 is in a flattened and folded configuration whereas, in the filled condition, the inner bag 30 is in a parallelepipedal and unfolded configuration, having a volume corresponding substantially to the volume of the housing 21 and being surrounded by the outer envelope 40 and the metal cage 20.

Therefore, when the inner bag 30 is filled to pass from the empty condition to the filled condition, the inner bag 30 unfolds from the flattened and folded configuration to the parallelepipedal and unfolded configuration.

Since the inner bag 30 is not fastened to the outer envelope 40, that is the inner bag 30 is free to move with respect to the outer envelope 40, the filling opening 31 of the inner bag 30, in an empty condition, can be moved and grasped by an operator to easy connect the filling opening 31 to a filling head of a filling machine (not shown in the figures). In order to easy the above operation, hanging means 47 are provided and configured for keeping the filling opening 31 of the inner bag 30, in empty condition, in the flattened and folded configuration, in correspondence of the upper opening 41 of the outer envelope 40.

According to one embodiment, the hanging means 47 are provided for hanging the inner bag 30, in particular the upper portion of the inner bag 30 near the filling opening 31, and keeping it suspended, flattened and folded, near the upper opening 41 of the outer envelope 40.

According to one embodiment, the hanging means 47 comprise a hanging member positioned inside the outer envelope 40 to hanging the upper portion of the inner bag 30 near the filling opening 31. In particular, the hanging member 47, in the example a ribbon, has two ends, each connected to opposite side walls 43 inside the outer envelope 40. By this way, the upper portion of the inner bag 30 near the filling opening 31 may be hanged to the rope 47 and keep suspended near the upper opening 41 of the outer envelope 40.

Alternatively, the hanging means 47 comprise a hanging member connected to the upper portion of the inner bag 30 near the filling opening 31 and intended to be hanged to a corresponding hanging member provided in the outer envelope 40, in correspondence of the upper opening 41 of the outer envelope 40.

A inner bag 30 of the type mentioned above is described in WO 2004/022440 the content of which is herewith incorporated.

Housing of the inner bag 30 of the type described in document WO 2004/022440 in a pallet container with standard pallet and metal cage enables the pallet container to be reused to transport known plastics material vessels such as IBCs, while the outer envelope 40 interposed between the inner bag 30 and the metal cage 20 confers upon the inner bag 30 greater mechanical strength and rigidity and enables the inner bag 30 to be contained inside the cage 20.

According to one embodiment, the outer envelope 40 is made of sufficiently strong material to contain the inner bag 30 inside the housing 21 of the cage 20 so as to prevent portions of the inner bag 30 from going beyond or extruding through the grids 24 of the metal cage 20 and coming out of the cage 20.

Advantageously, the outer envelope 40 is a protective bag interposed between the inner bag 30 and the metal cage 20 and the bearing surface 15 of the pallet 10, when the inner bag 30 is in the filled condition.

In the embodiment shown in the accompanying figures, the outer envelope 40 is made of raffia.

The cover 44 can be secured in a removable manner to the upper end 43*a* of the side walls 43 of the outer envelope 40 by means of a zip, Velcro or similar fastening means.

The outer envelope 40 also comprises at least one opening 45 for the passage of the draining/filling device 34 of the inner bag 30.

According to one embodiment, the container 1 has fastening means 46 to fasten the outer envelope 40 to the metal cage 20. In the embodiment, the fastening means 46 comprise a plurality of straps with a Velcro fastening spaced around the perimeter of the upper 43*a* end of the outer envelope 40 and capable of wrapping round the horizontal metal tubes 22 of the upper end 20*a* of the metal cage 20.

Typically, the draining device 34 of the inner bag 30 is arranged at the bottom of the inner bag 30 and projects outwards both from the inner bag 30 and from the metal cage 20. If the container 1 is to be maneuvered by means of a fork-lift truck, the fork-lift truck operator could therefore inadvertently knock the draining device with the prongs of the fork-lift truck, particularly if the container is filled and the pressure of the liquid inside the inner bag 30 causes the draining device 34 to protrude outwards beyond the cage 20, causing damage or possibly even the detachment of the draining device 34 from the inner bag 30. In order to overcome this drawback, the container 1 may be provided with a protective reinforcement shield 50 located at the draining device 34 so as to increase the rigidity of the inner bag 30 in the region that is weakest and exposed to risks as is the region around the draining device.

According to one embodiment, the protective shield 50 comprises a rigid plate interposed between the outer envelope 40 and the metal cage 20. The rigid plate 50 may be made of a plastics or metal material.

To set up the container 1, the pallet 10 with the metal cage 20 are arranged. Then, the outer envelope 40 is placed opened in the housing 21 of the metal cage 20 with the bottom 42 laying on the bearing surface 15 of the pallet 10 and the side walls 43 facing the metal cage 20. In order to keep the outer envelope 40 fastened to the metal cage 20, the fastening means 46 are fastened to the metal cage 20.

Afterwards, an operator open the cover top 44 to place a flattened and folded inner bag 30 in the outer envelope 40.

In particular, the flattened and folded inner bag 30 is positioned in the outer envelope 40 with the filling opening 31 kept hanged and so suspended in correspondence of the upper opening 41 of the outer envelope 40 to easy the connection of the filling opening 31 to the filling head of a filling machine.

Then, the operator provides for connection of a filling head of a filling machine to the filling opening 31 of the inner bag 30.

Upon connection of the filling opening 31 with the filling head, material can be let to flow into the inner bag 30 so that the inner bag 30 unfolds from the flattened and folded empty configuration to the filled parallelepipedal and unfolded configuration.

As can be appreciated from the above description, the container according to the present invention overcomes the drawbacks mentioned with reference to the known art.

In particular, the container can be reused for transporting vessels made of a plastics material or IBCs, since the dimensions of the pallet and metal cage are standard within the sector of IBC production. Furthermore, the presence of an outer envelope interposed between the inner bag and the metal cage confers greater rigidity upon the inner bag and allows the inner bag to be contained inside the cage. These features allow the pallet container, after the first use, to be reused, even for different applications, simply by replacing the inner bag or retrieving the pallet-container and using it as an IBC to transport a plastic vessel.

Alternatively, it is still possible to return the pallet container but not necessarily to the first supplier. In this case, the large number of companies worldwide intensively diffused specialised in the recycling/regeneration of IBCs can easily reuse the structure formed by pallet and metal gage, and this fact enables a drastic reduction in costs. This fact is more relevant if the following two aspects are considered. First, the biggest companies that produce IBC worldwide provide a recollect service of used IBC (because they are able to reuse the cages putting inside a rigid plastic tank. This service is usually for free or available for a very low cost. Second, a worldwide diffused market of used IBCs exists. For that, many private companies may buy a used IBC cage to put inside a rigid IBC inner plastic tank.

Obviously, a person skilled in the art, in order to meet contingent and specific requirements, could make numerous modifications and variations to the above-described container according to the invention, without departing from the scope of protection of the invention as defined in the following claims.

The invention claimed is:

1. A container for transport and storage of liquids comprising:

a pallet having a supporting platform with a bearing surface, said supporting platform having longitudinal dimension of 1200 mm and width dimension of 1000 mm or 800 mm, a metal cage mounted on said pallet and defining a housing, said metal cage comprising crossing vertical and horizontal metal tubes welded together at crossover points to form a lattice structure with a plurality of grids defining a respective plurality of openings, said metal cage developing vertically from the bearing surface of the pallet and having longitudinal and width dimension corresponding to longitudinal and width dimension of the pallet, wherein the upper end of said metal cage and the bottom end of said pallet have longitudinal and width dimensions configured to allow stackability of the pallet container, and wherein the bottom end of said pallet has lower longitudinal and width dimensions with respect to the longitudinal and width dimensions of the upper end of the metal cage, an inner bag made of plastic material, said inner bag having at least one opening for filling and/or emptying, an outer envelope positioned in the housing of the metal cage and fastened to the metal cage, said outer envelope being a protective bag flexible so as to be folded and rolled in a reversible manner, said outer envelope having a bottom supported by the bearing surface, side walls developing vertically from the bottom, an upper opening for introducing said inner bag in said outer envelope and a top cover for closing the upper opening, fastening means for fastening the outer envelope to the metal cage, wherein said inner bag is positioned in said outer envelope, said inner bag is not fastened to said outer envelope, said inner bag is configured to be filled to pass from an empty condition to a filled condition, in said empty condition, said inner bag being in a flattened and folded configuration, in said filled condition, said inner bag being in a parallelepipedal and unfolded configuration, having a volume corresponding substantially to the volume of the housing and being surrounded by said outer envelope and said metal cage, when filling to pass from said empty condition to said filled condition, said inner bag unfolds from said flattened and folded configuration to said parallelepipedal and unfolded configuration, said inner bag has a filling opening equipped with a cap and an empty opening equipped with a drainage device, whereby said filling opening is moveable with respect to the outer envelope when the inner bag is in the empty condition and in the flattened and folded configuration, said container further comprises a protective reinforcement shield located at the drainage device so as to increase the rigidity of the inner bag in the region of the drainage device, and hanging means configured for keeping said filling opening in correspondence of the upper opening of the outer envelope, when the inner bag is in the empty condition and in the flattened and folded configuration, and wherein said hanging means comprise a hanging member having two ends, each connected to opposite side walls inside the outer envelope and are configured for hanging the upper portion of the inner bag and keeping it suspended, flattened and folded, near the upper opening of the outer envelope.

2. A container according to claim 1, wherein said top cover is configured to pass in a reversible manner from an opened position to a closed position for allowing access inside the outer envelope.

3. A container according to claim 1, wherein said inner bag is loose with respect to the outer envelope, thereby the inner bag is free to move with respect to the outer envelope.

* * * * *